US005653149A

United States Patent [19]

Cavanagh

[11] Patent Number: 5,653,149

[45] Date of Patent: Aug. 5, 1997

[54] REMOVABLE CRANK FOR MANUALLY POWERED ROTARY DEVICES

[76] Inventor: Paul D. Cavanagh, 254 Middle Rd., Byfield, Mass. 01922

[21] Appl. No.: 535,935

[22] Filed: Sep. 28, 1995

[51] Int. Cl.[6] ..... B25G 3/26; G05G 1/12

[52] U.S. Cl. ..... 74/545; 403/324; 403/328; 16/114 R; 16/DIG. 24

[58] Field of Search ..... 74/543, 544, 545, 74/548; 254/344, 371; 403/328, 324; 16/114 R, DIG. 24, DIG. 40

[56] References Cited

U.S. PATENT DOCUMENTS

| | | | |
|---|---|---|---|
| 2,190,081 | 2/1940 | Pfauser | 403/328 |
| 2,590,610 | 3/1952 | Grosch | 254/344 |
| 3,073,192 | 1/1963 | Beers | 403/324 X |
| 3,810,703 | 5/1974 | Pasbrig | 403/324 |
| 3,865,500 | 2/1975 | Newell | 74/545 X |
| 4,571,113 | 2/1986 | Coren | 403/328 X |
| 4,883,255 | 11/1989 | Bacon | 74/545 X |

*Primary Examiner*—Charles A. Marmor
*Assistant Examiner*—Mary Ann Battista
*Attorney, Agent, or Firm*—Don Halgren

[57] ABSTRACT

A removable crank for driving various manually powered rotary devices, such as winches. The crank includes an improved mechanism for locking it to the device. The locking mechanism involves a manually retractable locking element located in the crank extension which interacts with a groove disposed in the crank receiving socket of the rotary device.

18 Claims, 2 Drawing Sheets

REMOVABLE CRANK FOR MANUALLY POWERED ROTARY DEVICES

BACKGROUND OF THE INVENTION

1. Field of the Invention

The present invention relates generally to a removable crank for applying manual power to a rotary device, such as a marine winch, and is more particularly concerned with a crank of the foregoing type and having improved locking means for securing same to the rotary device.

One type of manually powered rotary device to which the present invention is directed is a marine winch for drawing in or releasing, for example, lines, sheets and ropes on sailboats or, in the case of fishing or cargo boats, for hauling and/or lifting various diverse loads such as traps, nets and cargo. Marine winches broadly consist of a drum rotatably mounted on a base secured, for example, to the deck or rail of the boat. A removable crank handle is used to turn the drum, or in the case of a winch equipped with a reduction gear train, to turn the input drive shaft thereto.

The cranks utilized are preferably removable from the winch in order to facilitate removal of the rope or line, cleaning, storage and/or repositioning of the crank to overcome mechanical or physical deadspots in the rotation cycle. Such hand cranks are also desirably removable for purposes of passenger and crew safety and in order to avoid interference with the movement of the crew.

Another type of manually powered rotary device with which such removable cranks are commonly utilized are throttle controls for auxiliary engines in sailboats. Such controls are generally mounted in the cockpit or cabin of the craft and, when auxiliary power is not in service, such as when the boat is under sail, the crank is desirably removed from the throttle control and stowed for purposes of passenger and crew safety.

Yet other types of manually powered rotary devices susceptible of use of removable cranks therewith are various land based manually powered winches such as boat trailer winches, gin pole hoisting apparatuses, automotive winches and the like. Here, the provision of removable cranks for such devices provides the device with a convenient means for disabling same when not in use, thereby preventing, or at least mitigating, against unauthorized handling and/or vandalizing thereof.

As will be appreciated, while use of removable cranks in association with manually powered rotary devices of the foregoing types is certainly highly desirable, it is obviously essential that the removable crank utilized for such applications comprise suitable means by which the crank may be securely locked into its operating engagement with the rotary device. This is so because winch operations often involve heavy imposed loads during which, if the driving connection between crank and winch is inadvertently lost, catastrophic results may ensue. Such locking security is also essential in auxiliary power throttle operations because sailboat auxiliary power is often used for purposes of precisely navigating the boat in critically close quarters such as in harbors, narrowly marked channels, estuaries and the like. Under these conditions the loss of throttle control due to accidental dislodgement of the crank from the throttle, even if only temporary in nature, can obviously lead to substantial adverse results.

2. Description of the Prior Art

Removable cranks generally comprise an elongate lever or moment arm having a handle rotatably secured to one end thereof for manipulation by the user and an extension fixed to the other end thereof, said extension extending in a direction opposite the direction of the handle. Typically, the extension is keyed and mates with a cooperatively keyed socket in the power receiving element of the manually powered rotary device. A particularly desirable keying or spline geometry for the crank extension is known as the double square, i.e., the extension, taken in cross section, has the geometry of two superimposed squares rotated 45° with respect to one another. This type of cross sectional geometry of the crank extension is well illustrated in, for example, U.S. Pat. No. 3,962,935, to Hutton et al.; and U.S. Pat. No. 4,225,118, to Ottemann. The common method of locking the crank in place is to provide a single square plate rotatably mounted below the free end of the keyed extension, said plate being rotatably operable by means of a knob attached to a shaft housed within the longitudinal axis of the extension. When the plate is aligned with one or the other of the squares of the extension the handle may be inserted or removed from its receiving socket. When the square plate is rotated from this aligned condition the corners of the square instead align with one set of the splines or keys of the socket to prevent removal therefrom.

Referring to FIG. 1 hereof, there is shown in perspective an illustration of the prior art removable crank mechanism as known to the present applicant and as applied to a sailboat winch representing the manually powered rotary device. Winch drum 10 is rotatably mounted on base 12 and comprises a keyed socket 14 for receiving mutually keyed crank extension 16 affixed to one end of crank lever arm 18. A handle 17 for gripping and manipulation of the crank by the operator is journalled to the other end of the crank lever arm 18 and extends in a direction opposite that of the crank extension 16. Retaining plate 20, shown at an exaggerated distance from the lower surface of extension 16, is fixedly secured to rotatable shaft 22. Shaft 22 is rotatably housed within the axis of the extension 16 and is affixed at its upper end to knob 24, also shown at an exaggerated distance from the upper surface of the lever arm 18.

Socket 14 and extension 16 are each correspondingly formed in the above described geometry of the double square, thereby providing the extension 16 with a plurality of driving surfaces 16(*a*) which mate and cooperate with the corresponding driven surfaces 14(*a*) of socket 14. Plate 20 is exactly in the cross sectional dimensions of one of the squares of the crank extension 16. Thus, when the plate 20 is aligned with one of the sets of the squares of the crank extension 16, said extension will fit the socket and be engageable therewith. Once so engaged the plate 20 is rotated approximately 22.5° by means of knob 24, thereby to cause the corners thereof to underlie the keys or splines of the socket 14 and to thereby prevent disengagement and withdrawal of the crank extension 16 from the power receiving socket 14. When removal of the crank is desired, the knob 24 is manipulated to bring the plate 20 back into alignment with one of the sets of the squares of the crank extension 16, thereby freeing the extension 16 for removal from the socket 14.

The holding or locking forces in the removable crank of the prior art are thus borne mainly by the corners of the square plate 20 and its point of attachment to the shaft 22. In practice, the rough handling often imposed upon such cranks, particularly in winch operations, leads to the quick destruction of the plate 20 by fracture thereof, by peening of its corners and/or by disengagement of the plate from its fixation to the rotatable shaft 22. Too, by its positioning at the end of the crank extension 16, when the crank is removed from the socket 14 the sharp exposed multiple corners of the plate 20 can often be damaged by accidental impact with hard exterior surfaces, or can themselves do injury to other object surfaces or personnel if the removed crank is improperly stowed, acidentally dropped or otherwise inartfully handled.

The present invention presents an alternative approach to securing a removable crank into the receiving cooperative socket of a manually powered rotary device by providing the crank extension with a retractable elongate locking element slideably housed therein. Means are provided by which the free end of the retractable locking element can be extended to a locking condition and retracted to a removal condition, said free end, when in the extended locking condition of the locking element, engaging a cooperative circumferential groove disposed in the receiving socket. Manual control of retraction of the locking element from its locking engagement with the circumferential groove is achieved by means located exterior of the extension. Desirably, the locking element of the crank of the present invention is disposed at a substantial angle relative to the transverse plane of the extension. The locking element of the crank, when the crank extension is received in the socket of a manually driven rotary device and said element is in the extended locking condition, permits the crank extension to rock or cock into a slightly off axis condition relative to the receiving socket under the manual forces applied at the handle end of the crank. Such cocking of the extension relative to the socket causes the driven surfaces of the socket and the driving surfaces of the extension to wedge beneficially together throughout substantially the entire rotation cycle of the crank while avoiding the imposition of injurious stresses upon the locking element.

As will be better understood from the following description the removable crank of the present invention provides for rapidity, security and ease of engagement and disengagemnt thereof to and from the receiving socket of a manually powered rotary device while exhibiting greatly improved service life relative to the prior art discussed above. In addition, the crank of the present invention, when removed from the manually powered rotary device employing same, avoids presentation of multiple sharp and potentially injurious corners to the environment.

Other objects and advantages of the present invention will, in part, appear hereinafter and will, in part, be obvious.

SUMMARY OF THE INVENTION

The invention may be summarized as a removable crank for applying power to a manually powered rotary device and which provides for positive locking in and rapid removal thereof from the power receiving socket of the rotary device. The crank broadly comprises an elongate lever arm, a handle rotatably mounted at one end thereof and a keyed or splined extension extending oppositely of said handle and being affixed to the other end thereof. Said keyed extension is shaped to be received and mate in driving relationship with a corresponding socket in the power receiving element of a manually powered rotary device. The socket comprises a circumferential groove and the keyed extension of the crank comprises an elongate retractable locking element having a free end slideably housed therein and which locking element, in the extended condition, projects said free end into engagement with the circumferential groove of the socket. Thus, in said extended condition, the locking element positively prevents disengagement of the keyed extension from the socket. Control means exterior the extension are provided to manually control at least retraction of the locking element. Upon retraction thereof the free end is withdrawn from the circumerential groove of the socket, thereby to permit removal of the crank extension and crank therefrom. In a preferred embodiment the slideable locking element is continuously spring biased to the extended or locking condition, thereby providing substantial mechanical integrity as well as smoothness of operation and overall reliability.

DESCRIPTION OF PREFERRED EMBODIMENT(S)

Figure 2:
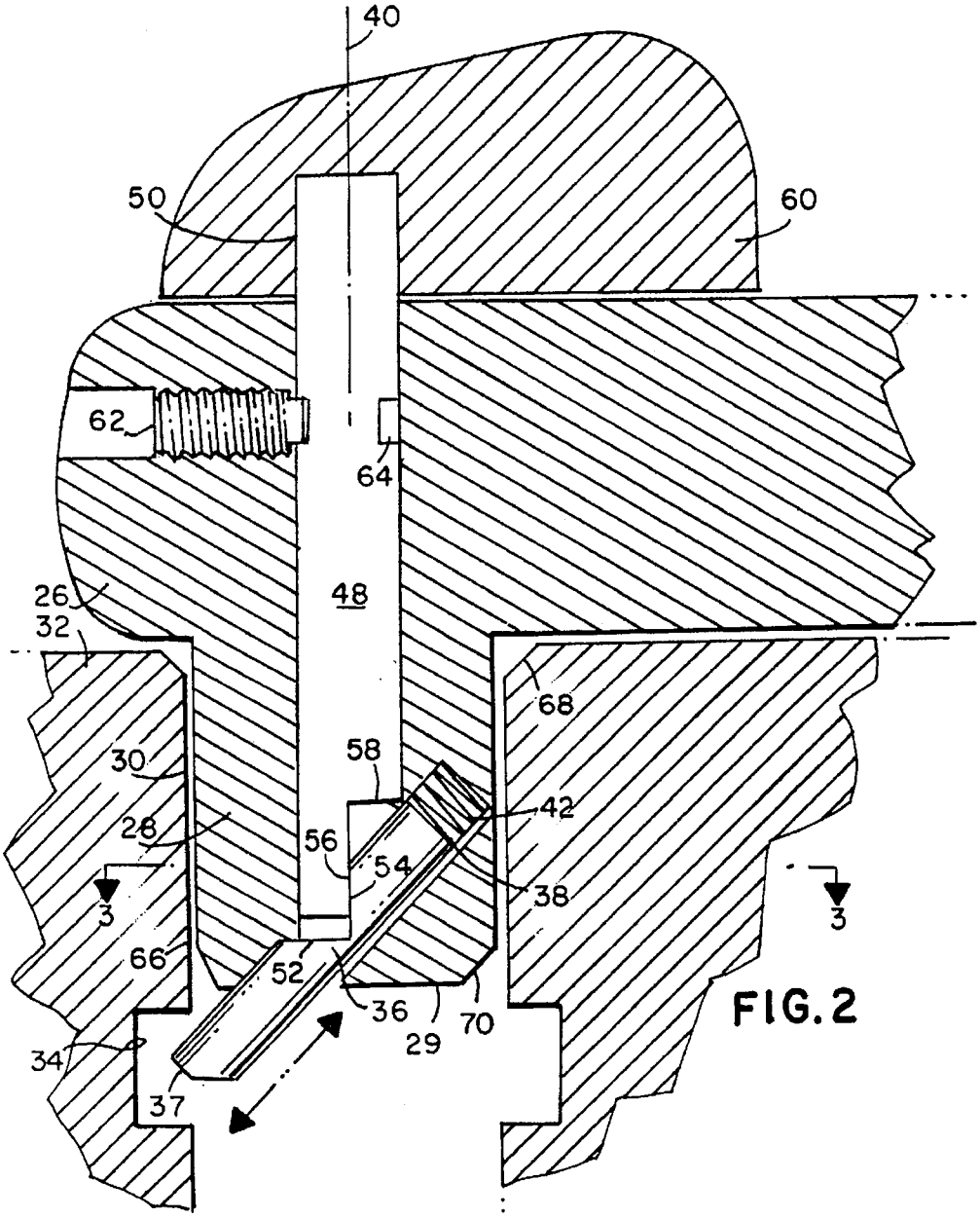
FIG. 2 is a sectional elevation view of a preferred embodiment of the present invention showing the locking element thereof in the extended locking condition.
Figure 3:
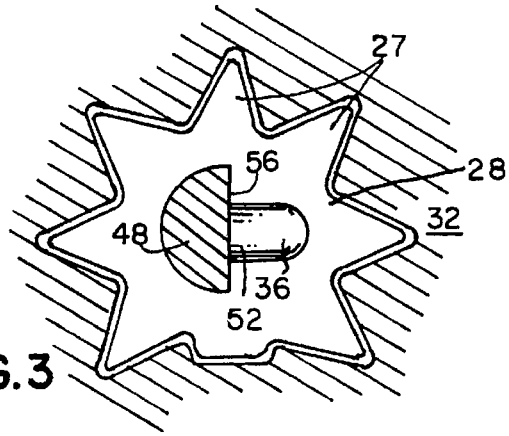
FIG. 3 is a plan cross sectional view of the embodiment of FIG. 2, taken along lines 3—3 thereof.

Referring now generally to FIGS. 2 and 3, wherein like reference numerals refer to like structures, crank lever arm 26 has a keyed or splined crank extension 28 affixed to one end thereof and which crank extension 28 cooperates with cooperatively keyed or splined socket 30 disposed in the manual power receiving element 32 of a manually powered rotary device. As previously mentioned, the particular type of rotary device to which the removable crank of the present invention is applied is not critical, although said crank is particularly suitable for use in connection with winches, generally, and marine winches of the direct or reduction gear drive type. Thus, where the rotary device is a direct drive winch, the power receiving element 32 containing the socket 30 will ordinarily be the hub of the winch drum. In a geared winch, however, the power receiving element 32 will be constituted by the power inlet shaft of the gear train driving the winch drum and the socket 30 will be formed in said shaft. In other manually powered rotary devices, such as throttles, the socket 30 will be similarly situated. Accordingly, the proper location of the socket 30 with respect to the many manually powered rotary devices to which the crank of the present invention may be put will generally be obvious to those of skill in the art.

The particular form of cooperative keys or splines of the extension 28 is a matter of design choice but is preferably of the double square type as previously discussed and which is most clearly illustrated in the cross sectional plan view of the invention shown in FIG. 3. A circumferential groove 34 is disposed about the periphery of the socket 30 and is of at least somewhat greater diameter than that of the socket 30. Said circumferential groove 34 is continuous, thereby to allow the keyed extension 28 to be lockably engaged into the socket 30 at any of the angular rotational positions relative to the socket 30 as may be permitted by the specific cross sectional geometries of the socket 30/extension 28 combination. In the case of the double sided square arrangement shown in FIG. 3, for example, the crank can be engaged in the socket in any of eight rotational positions relative thereto.

Figure 1:
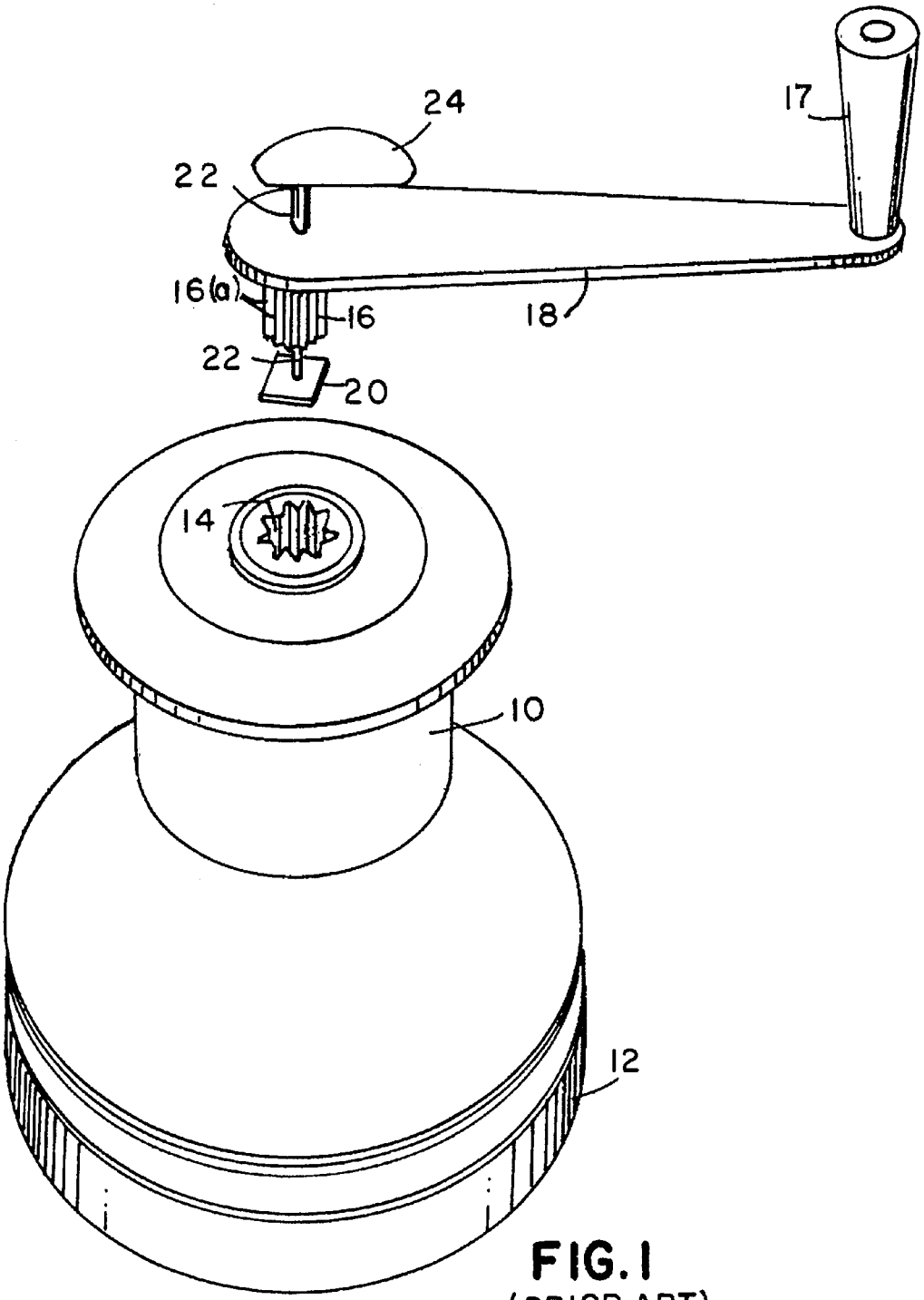
FIG. 1 (PRIOR ART)
FIG. 1 is a perspective view illustrative of a prior art crank device serving a manually powered rotary device in the nature of a sailboat winch.

Retractable elongate locking element 36 is slideably housed in a passageway 38 formed in crank extension 28 and which passageway is directed outwardly from the central axis 40 thereof. The passageway 38 is directed such as to lead to the exterior of the extension 28, including transversely and diametrically thereto. However, said passageway 38 is preferably directed at a substantial vertical angle relative to the transverse plane of the extension, said plane being defined by construction line 3—3 of FIG. 1. By directing the passageway 38 in this angled manner the bearing surface on the elongate locking element 36, and thus the support rendered by the passageway thereon, is maximized. Most preferably, the passageway 38 is disposed at a downward angle of approximately 45° relative to the transverse plane of the crank extension 28. It is also preferred that the passageway 38 pass to the exterior of crank extension 28 through the bottom 29 thereof, thereby to avoid compromise of the integrity of any of the key or spline elements 27 (FIG. 3) thereof.

Retractable elongate locking element 36 is of a length such that it can be extended sufficiently so as to cause the free end 37 thereof to protrude into the space defined by groove 34 (as shown in FIG. 2) and can be retracted sufficiently such that said free end is completely withdrawn from said groove. The locking element 36 may be in the nature of a bar, rod or pin, my preference being that said locking element be of round cross section, such as a rod or pin.

Preferably, the retractable elongate locking element 36 is continuously biased outwardly to its extended or locking condition. This may be conveniently achieved by means of a compression spring 42 located in the base or blind end of passageway 38, said spring acting against the inner end of the locking element 36. The spring 42 thus continuously biases the locking element 36 outwardly into its extended locking condition with respect to groove 34, thereby mitigating against unintentional retraction and loss of its locking function.

The locking construction of the invention includes external control means by which the elongate locking element 36 can be retracted from its extended locking condition. In the preferred embodiment of the invention shown said control means comprises a bore 50 extending downwardly through the top of crank extension 28 and a cylindrical shaft 48 rotatably disposed within said bore. Said cylindrical shaft 48 communicates with the retractable elongate locking element. Notch 52 is formed in locking element 36, said notch 52 defining a vertical flat surface 54 which faces corresponding flat surface 56 formed by notch 58 in shaft 48. The upper end of shaft 48, which extends exteriorly of the crank extension 28 and crank arm 26, has a knob 60 securely attached thereto. The shaft 48 is rotatably secured in the bore 50 by means of set screw 62 which is threaded through the end of crank arm 26 and whose inner end fits into groove 64 provided in shaft 48. The resulting combination of these elements provides a manual control system whereby, upon rotation of knob 60 and shaft 48, the flat vertical surface 54 of the shaft 48 acts against the corresponding surface 52 of elongate locking element 36, thereby camming said locking element rearwardly against the action of compression spring 42 and retracting the free end 37 thereof from locking engagement with the groove 34 and allowing removal of the crank from the socket 30. Conversely, upon release of the knob 60, the compression spring 42 acts to bias the elongate locking element 36 outwardly to its extended locking condition, the flat surface 52 of said element 36 camming the flat surface 54 of shaft 48 and rotating same, along with the knob 60, back to the positions occupied by these elements prior to the retraction step. The control means described above also provides for insertion of the crank extension 28 into the socket 30 without manipulation of the knob 60. Here, the extension 28 is simply placed into the socket 30, the free end 37 of the spring biased elongate locking element 36 making contact with the socket wall 66 and thus causing the element 36 to retract sufficiently into the crank extension 28 as to permit full insertion thereof into said socket. As the free end 37 of locking element 36 passes by the keyed wall 66 and into the groove 34 of the socket the locking element 36 is stroked outwardly into its extended locking condition under the biasing action of spring 42. Chamfer 68, located about the opening of socket 30 and chamfer 70, located about the bottom edge of the crank extension 28, facilitate this mode of insertion.

FIG. 3 is a cross sectional view along line 3—3 of FIG. 2 wherein like numbers refer to like parts. As will be seen, shaft 48 is constrained to rotate axially within the crank extension 28 while the elongate locking element 36 is constrained to slide with a substantial transverse component relative thereto.

It will be noted that the free end 37 of the single elongate locking element 36 of the present invention protrudes into only a single area of the circumferential groove 34. Thus, unlike the prior art crank discussed above, wherein the four corners of the square retaining plate support the extension relatively rigidly in the socket, the removable crank of the present invention permits cocking and wedging of the crank extension relative to the socket under the forces applied to the handle end of the crank and substantially throughout the entire rotation cycle thereof. This is advantageous because such wedging forces as may generated between the keyed crank extension and the receiving socket during operations aid substantially in preventing accidental disengagement therebetween. Moreover, said cocking and wedging forces, again unlike those experienced with the prior art removable crank, impose little or no destructive stresses on the locking element 36 of the present invention.

While the foregoing description demonstrates certain preferred embodiments of the invention and techniques for the implementation and use thereof, it should be recognized and understood that said description is not to be construed as limiting in nature because many obvious changes, modifications, substitutions and variations may be made therein without departing from the essential scope, spirit or intention of the invention. For example, with respect to the external manual control means by which the elongate locking element 36 is retracted from its extended condition, many suitable alternative constructions will be obvious. One such alternative may comprise an external plunger acting through a spring loaded rod, said rod having an appropriately conformed camming surface which, when said rod is depressed by action of the plunger, serves to cam the locking element 36 into its retracted disengaged condition. Another alternative is to provide said locking element 36 with a toothed rack and the shaft 48 with a cooperatively toothed pinion and whereby, upon rotation of the external knob 60, the locking element 36 is similarly retracted.

Further modifications to the structure disclosed above may also be made. For example, the retractable elongate locking element 36, spring 42 and cylindrical shaft 48 can be housed within a sub-assembly composed of a material of greater hardness, durability or natural lubricity than that of the material of construction of the crank extension 28 and/or crank lever arm 26. Such a sub-assembly can then be disposed within a suitable well formed in said crank extension 28 and/or crank lever arm 26.

It will also be appreciated that while the invention has been presented as particularly applicable to sailboat winches, it is obvious that it may also be beneficially employed with respect to substantially any manually powered rotary device wherein secure engagement of the crank and/or rapid removal thereof from the device is either essential or desired.

What is claimed is:

1. In a removable crank for use in manually powered rotary devices having a keyed receiving socket therefor and a continuous circumferential groove within said socket, said crank comprising an elongate crank arm, a handle rotatably journalled to one end thereof and extending upwardly therefrom and a keyed crank extension affixed to the other end thereof and extending downwardly therefrom, the improvement which comprises:

means to lock said crank extension into said circumferentially grooved socket comprising:

(A) said crank extension having a longitudinal axis, a plane transverse to said axis, an exterior surface and a free end defining the bottom thereof, a passageway formed in said crank extension, said passageway extending outwardly from said extension to the exterior surface thereof;

(B) a retractable elongate locking element slideably disposed in said passageway and having a free end, said element having an extended locking condition whereby said free end protrudes from said exterior surface and a retracted unlocked condition whereby said free end is withdrawn into said passageway;

(C) means to translate said locking element into said extended locking condition; and (D) manual control means external of said extension and communicating with said locking element, said control means being manipulable to retract said locking element from said extended locking condition to said retracted unlocked condition, said manual control means comprising a bore extending downwardly through said crank extension, a shaft rotatably mounted within said bore to engage said elongate locking element whereby rotation of said shaft causes retraction of said element, said shaft having an upper end extending exteriorly of said crank extension and having a knob affixed thereto.

2. The improvement of claim 1 wherein said means to translate comprises means to continuously bias said elongate locking element to said extended locking condition.

3. The improvement of claim 2 wherein said means to continuously bias said elongate locking element is a spring.

4. The improvement of claim 1 wherein said passageway is directed at a substantial vertical angle relative to the transverse plane of said crank extension.

5. The improvement of claim 4 wherein said angle is about 45° downward of said transverse plane.

6. The improvement of claim 1 wherein said passageway passes to the exterior surface of said crank extension through the bottom thereof.

7. The improvement of claim 1 wherein wherein said retractable elongate locking element is of circular cross section.

8. The improvement of claim 1 wherein said passageway is directed diametrically of the longitudinal axis of said crank extension and at a selected vertical angle relative to the transverse plane thereof.

9. The improvement of claim 1, including spring means to continuously bias said elongate locking element to the extended locking condition thereof.

10. In a manually powered winch having a rotatable drum operable by a removable crank, said crank having a keyed crank extension and said winch having a keyed socket for receiving said crank extension, the improvement which comprises means to lock said extension into said socket, said means comprising:

(A) said socket having a continuous circumferential groove;

(B) said crank extension having a longitudinal axis, a transverse plane, a free end defining the bottom thereof and an exterior surface, said crank extension having a passageway formed therein, said passageway extending outwardly from said extension to the exterior surface thereof;

(C) a retractable elongate locking element disposed in said passageway and having a free end, said element having an extended locking condition whereby said free end protrudes into said groove of said socket and a retracted unlocked condition whereby said free end is withdrawn from said groove;

(D) means to translate said locking element into said extended locking condition; and (E) manual control means external of said extension and communicating with said locking element, said control means being manipulable to retract said locking element from said extended locking condition to said retracted unlocked condition, said manual control means comprising a bore extending downwardly through said crank extension, a shaft rotatably mounted within said bore to engage said elongate locking element whereby rotation of said shaft causes retraction of said element, said shaft having an upper end extending exteriorly of said crank extension and having a knob affixed thereto.

11. The improvement of claim 10 wherein said means to translate comprises means to continuously bias said elongate locking element to said extended locking condition.

12. The improvement of claim 11 wherein said means to continuously bias said elongate locking element is a spring.

13. The improvement of claim 10 wherein said passageway is directed at a substantial vertical angle relative to the transverse plane of said crank extension.

14. The improvement of claim 13 wherein said angle is about 45° downward of said transverse plane.

15. The improvement of claim 10 wherein said passageway passes to the exterior surface of said crank extension through the bottom thereof.

16. The improvement of claim 10 wherein said retractable elongate locking element is of circular cross section.

17. The improvement of claim 10 wherein said passageway is directed diametrically of said longitudinal axis of said crank extension and at a selected vertical angle relative to the transverse plane thereof.

18. The improvement of claim 10, including spring means to continuously bias said elongate locking element to the extended locking condition thereof.

* * * * *